United States Patent [19]

Ahn

[11] Patent Number: 4,571,782

[45] Date of Patent: Feb. 25, 1986

[54] FASTENING MEANS FOR A BOOTLACE

[76] Inventor: Yu H. Ahn, 481, Hyomock-dong, Dong-ku, Taequ-shi, Rep. of Korea

[21] Appl. No.: 370,671

[22] Filed: Apr. 22, 1982

[30] Foreign Application Priority Data

Nov. 20, 1981 [KR] Rep. of Korea ..... 7873/81[U]

[51] Int. Cl.[4] ..... A43B 11/00

[52] U.S. Cl. ..... 24/141; 24/117; 24/119; 24/128; 36/50

[58] Field of Search ..... 24/141, 117, 119, 128, 24/129 A, 122.6; 36/50

[56] References Cited

U.S. PATENT DOCUMENTS

| | | | |
|---|---|---|---|
| 435,392 | 9/1890 | Byrns | 24/119 |
| 604,126 | 5/1898 | Schultz | 24/119 |
| 1,474,396 | 11/1923 | Bapis | 36/50 |
| 2,253,860 | 8/1941 | Martin | 36/50 |

FOREIGN PATENT DOCUMENTS

| | | | |
|---|---|---|---|
| 181518 | 3/1936 | Switzerland | 36/50 |

*Primary Examiner*—Victor N. Sakran
*Attorney, Agent, or Firm*—Oblon, Fisher, Spivak, McClelland & Maier

[57] ABSTRACT

A fastening mechanism for the bootlace of a boot, which includes two upright and serrated side edges provided on either side of a cut-open portion of a boot to form teeth and notches all along the length of the edges, each tooth having an eyelet and projecting upward in the same direction of a lace running diagonally from one eyelet to the next-upper one on the other side to effect a better delivery of power of pull on eyelets for even tightening. Each of the teeth and notches gradually becoming larger in width and height step by step upwardly and equally on either side to effect a larger spacing between adjacent eyelets at each step upward, consequently resulting in a lesser number of eyelets being required and in less friction of the lace between the eyelets and a tongue provided on the inner side of the fastening edges, and including a lacing both ends of which are run initially outward through the bottom eyelets from the inner side to run to the next-upper eyelets on the opposite sides to continue in the same manner through them again to the next-upper eyelets on respective sides to effect an instant, simultaneous and uniform fastening throughout all eyelets, to bring comfort to the feet of the wearer under any condition and shortening of time of a fastening action for emergency operations such as military operations.

1 Claim, 2 Drawing Figures

FASTENING MEANS FOR A BOOTLACE

BACKGROUND OF THE INVENTION

1. Field of the Invention

The present invention is related to a fastening means of bootlace and is intended to tighten, or loosen the lace quickly with little pulling strength under any condition and to relieve any harmful pressure of the boot against foot and ankle.

2. Discussion of the Background

In the prior art, the fastening portion of lacing in a boot has straight side edges with a plurality of eyelets spaced evenly on either side to run a lacing therethrough.

While the lacing is being pulled in order to tighten for fastening, the strength of pull applied has to be increased with friction resistance in proportion to the number of eyelets, besides the pulling power on the lace through the upper eyelets is not delivered through the lacing to the lower eyelets.

That is, when both ends of the lace are pulled only the parts nearest the application of pull is partially tightened while most of the other parts remain unaffected.

Therefore, fastening of the whole portion in a conventional way requires that the lacing be tightened step by step at a time through the eyelets from the lower part upward to the top by pulling each portion of the lacing between eyelets, thereby taking up much time and energy in fastening.

Vice versa, for loosening, the lacing has to be pulled with fingers at each part between eyelets one by one downward, taking as much time as for fastening.

Particularly at night, it takes much more time to tighten or loosen the fastening lace than in the day time.

In military services, the inconvenience of fastening and loosening a lace even results in an insanitary tendency for military men not to take off their boots often enough causing sometimes athlete's foot or frostbite.

Also, in a long walk, or climbing, or crouching and squating with boots such as military boots or sporting boots, some parts in the fastening portion are folded to effect pressures against ankle and instep, thereby resulting in an earlier fatigue, swelling, irritation and blisters and to cause difficulty in walking.

SUMMARY OF THE INVENTION

The present invention is intended to improve the above stated inconveniences and drawbacks of conventional boots.

The configuration of the invention is such that the side edges with eyelets on either side form a serration at a level of each eyelet, instead of going in a straight line as in conventional boots, the teeth of which, each comprising an eyelet, are projected upward in the same direction as that of the running of the lace, each end of the lace running diagonally crossways through eyelets from one eyelet to the next upper one on the opposite side.

The teeth are also arranged to become gradually larger in size than the one immediately underneath and to have a greater spacing between eyelets at each step upward than the lower one, so that the number of eyelets may be much reduced from those of the prior art, with a consequence of less friction on the lace.

Each end of the lace run through the eyelets at the top is self-bound to form a knot.

The invention, as stated above, is such that a little pulling strength applied simultaneously on both ends of the lace may be delivered simultaneously all through the lace to effect a quick, easy and uniform fastening almost simultaneously between all eyelets.

The gradual increase of the spacing distance between adjacent eyelets step by step is intended to effect a larger angle of running of the lace at each step upward to give more pulling power of pull on the lower eyelet than on the upper one on either side.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
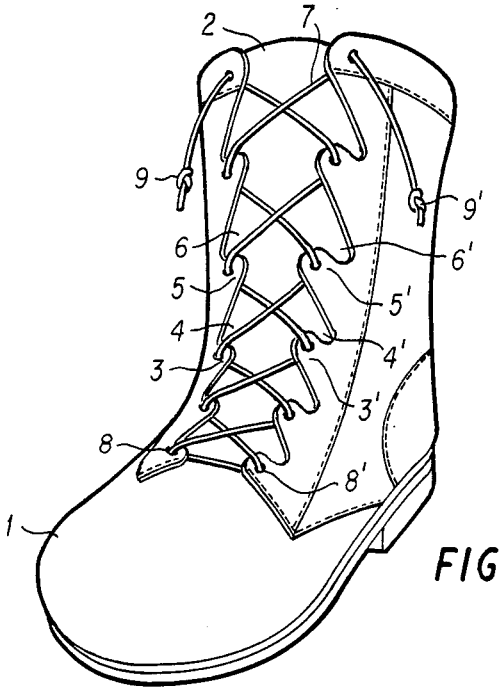
FIG. 1 shows a perspective view of the lace fastening portion in a boot in accordance with the present invention.
Figure 2:
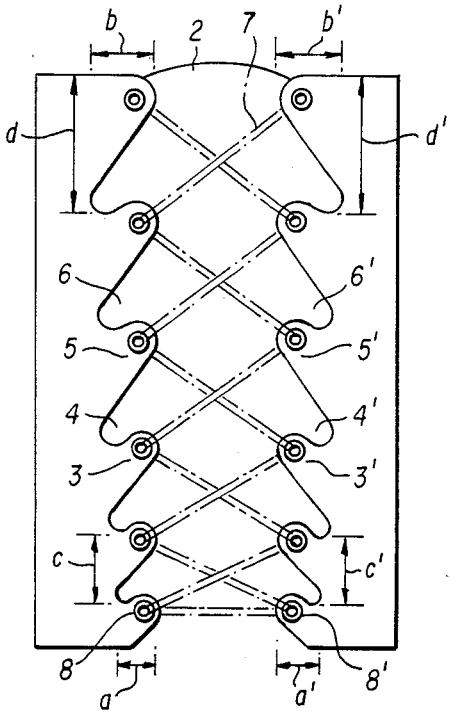
FIG. 2 shows an enlarged front view of a partial portion of the lace fastening.

The present invention is described in reference to the drawings, as follows;

There is provided a known tongue (2) on the inner side of the fastening portion of the boot (1), and the side edges for fastening are cut in a form of serration so that the projecting teeth such as (3), (3'), (5') (5') are directed upward in the same direction as that of a bootlace (7) of synthetic fiber running crossways through eyelets provided on the edges. Also the teeth are arranged to become gradually larger in width and height one after another with an effect of greatly reducing the number of eyelets from that of a conventional boot.

The ends of the lacing are self-bound to have a knot on each, as (9), (9').

Teeth (5), (5') are arranged to be larger in width and height than that of teeth (3), (3'), and in the same manner other teeth also increase their sizes as they go upward step by step equally on either side.

The same principle is applied to the notches between teeth, as notches (6), (6') are arranged to be larger in width and height than notches (4), (4').

Therefore, the heights (b), (b') are taller than (a), (a') and the spacings (d), (d') are greater than (c), (c').

The bootlace (7) is put through eyelets (8), (8') with each end coming out through the respective eyelet from the inner side of the eyelet, and then the ends are run diagonally crossways to each other to be put through the next upper eyelet on the opposite side one after another, the ends always coming out through the hole from the inner side and the lace portions, running from left to right or vice versa, always coming over the other portions running in the opposite direction, as shown in the FIG. 1.

While both knots (9), (9') of the lacing, each being held by a respective hand on either side, are pulled in order to fasten a boot of the invention, the strength of pulling applied is concentrated and delivered in an even distribution along the line of the lace running diagonally through eyelets as between teeth (3), (5') and (3'), (5) due to harmony in the directions of the running of the lace and projection of each tooth and on account of much less friction resistance occurring between the eyelets and the tongue than in the conventional boots, thus enabling to make a quick, easy and equal fastening of a boot by one simple pull of the knots (9), (9').

In the opposite procedure for loosening, a small pulling force is applied with fingers to the teeth (3), (3') and (5), (5') to pull the same open outward on either side to allow for quick and easy loosening of the lace, thus saving much time in loosening.

The present invention may be applied to military boots, ski-boots, skate boots, climbing boots, work-boots and other sport footwear.

The number of teeth and the angle of running of the lace and of projection of a tooth are not limited, and any adjustment of them may be made within the scope of the invention as the case requires.

The principal object of the invention is to facilitate putting on and removal of boots on a short period of time under any condition and even in darkness, by just pulling the knots (9), (9') of the lace.

A characteristic of the invention is such that the lace is tightened evenly all along the fastening portion from top to bottom to make the foot comfortable, whereas the conventional method of fastening has been to pull the lace at each step of eyelets one by one with a result of some portions partially more tightened and others less tightened to bring a discomfort of the foot.

Another advantage of the invention is to relieve the pressure of the boot cover on the part of ankle and instep of the foot through means of serrations formed at the side edges to keep the foot comfortable while walking, running and climbing.

A further advantage of the invention is to help shorten some time-records in sporting and maintain good circulation of blood without any harmful pressure on any part of the foot even during a long walk.

Another advantage of the invention, when applied to military boots where a quick wearing on-and-off of boots is very desirable in an emergency, or in activities of night and cold weather, as well as in peace time, is that the time required for boot fastening action of military personnel is much shortened so as to render greater service to military operations.

That is, for example, a pair of conventional boots takes about two minutes and ten seconds to be put on and fastened completely. However, the present invention takes only a maximum of twenty seconds to complete the fastening. This means that a soldier who can run 100 m in 20 seconds with a complete personal armament will be able to proceed 600 m further in running, and that a rifle soldier can fire 1,400 rounds more of ammunition with an M 16(A 1) rifle and an artillery man can fire 6 more shells, in the saved time of 2 minutes.

Another advantage of the invention is that, in military activities such as crawling, shooting and long marching which are apt to often cause bendings of boots, the discomfortable and harmful pressure on the feet of the soldiers is eased, and that the convenient means of easy fastening results in an effect of more frequent taking-off of boots to help prevention of athlete's foot or frostbite that may occur.

Furthermore, the configuration of the invention is so formed that there is nothing to hinder mass production, or to increase production cost more than in the prior art.

The bootlace (7) of the invention, that is pressured, as stated in above, to run outward through eyelets (8), (8') from the inner side, may be turned the other way round to run inward from the outer side.

Also, in cases of longer boots such as military boots, skating boots, climbing boots and work boots, the teeth portion on either side may be divided into two parts, each half to have different sized but uniform teeth in its portion and the teeth of the upper half to be larger than those of the lower one, so that the lower portion may be able to make adjustment for boot fitness according to the user's foot size and the upper one may have a lesser number of teeth than in the lower portion to better facilitate fastening of the boots. In addition the heights (a), (a') and (b), (b') may be arranged into same sizes.

Obviously, numerous modifications and variations of the present invention are possible in light of the above teachings. It is therefore to be understood that within the scope of the appended claims, the invention may be practiced otherwise than as specifically described herein.

What is claimed is:

1. A fastening means for the lace of a boot, comprising:

first and second upright side edges located on said boot, provided at a cut-open portion of said boot so as to face one another, wherein said edges further comprise a plurality of alternate upwardly projecting teeth having notches formed therebetween, each of said teeth having an eyelet and a portion projecting upwardly running diagonally toward an eyelet formed in a tooth positioned opposite and upward therefrom, each of said teeth and said notches increasing in width and height in series upwardly and equally on said first and second side, wherein a spacing between adjacent eyelets on each of said first and second sides is continuously increased in an upward direction for minimizing the required number of eyelets and for minimizing friction and wherein the lowermost spacing is smaller than the uppermost spacing and wherein the height of said teeth on said first and second sides increases from a lowermost tooth to an uppermost tooth.

* * * * *